US011710611B2

(12) United States Patent
Kosse et al.

(10) Patent No.: US 11,710,611 B2
(45) Date of Patent: Jul. 25, 2023

(54) CIRCUIT BREAKER

(71) Applicant: SIEMENS ENERGY GLOBAL GMBH & CO. KG, Munich (DE)

(72) Inventors: Sylvio Kosse, Erlangen (DE); Paul Gregor Nikolic, Erlangen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 201 days.

(21) Appl. No.: 17/275,784

(22) PCT Filed: Sep. 5, 2019

(86) PCT No.: PCT/EP2019/073668

§ 371 (c)(1),
(2) Date: Mar. 12, 2021

(87) PCT Pub. No.: WO2020/053056

PCT Pub. Date: Mar. 19, 2020

(65) Prior Publication Data

US 2022/0216021 A1 Jul. 7, 2022

(30) Foreign Application Priority Data

Sep. 12, 2018 (DE) ..... 10 2018 215 507.0

(51) Int. Cl.
*H01H 33/14* (2006.01)
*H01H 33/666* (2006.01)

(52) U.S. Cl.
CPC ..... *H01H 33/6664* (2013.01); *H01H 33/14* (2013.01); *H01H 2033/6667* (2013.01)

(58) Field of Classification Search
CPC .. H01H 33/6664; H01H 33/666; H01H 33/66; H01H 33/14; H01H 2033/6667; H01H 3/46; H01H 33/022
USPC ..... 218/118, 4, 5, 7, 10, 119, 152
See application file for complete search history.

(56) References Cited

U.S. PATENT DOCUMENTS 3,527,910 A * 9/1970 Kline ..... H01H 33/666 218/120
3,582,588 A 6/1971 Cichocki et al.
3,597,556 A * 8/1971 Sharp ..... H01H 3/46 218/4
3,792,213 A 2/1974 Kane et al.
4,457,063 A * 7/1984 Hockele ..... B60M 1/18 191/40
4,492,835 A * 1/1985 Turner ..... H01H 33/6661 218/7

(Continued)

FOREIGN PATENT DOCUMENTS

CH 477081 A 8/1969
DE 102015212826 A1 1/2017

(Continued)

*Primary Examiner* — William A Bolton
(74) *Attorney, Agent, or Firm* — Laurence A. Greenberg; Werner H. Stemer; Ralph E. Locher

(57) ABSTRACT

A circuit breaker for connecting at least two line sections in an interruptible manner has at least one pair of vacuum tubes, each with a stationary switching contact and a movable switching contact. The switching contacts of the vacuum tubes are electrically connected in series. The movable switching contacts of the vacuum tubes are coupled to a common actuator and can be simultaneously switched by a movement of the actuator.

11 Claims, 4 Drawing Sheets

(56) References Cited

U.S. PATENT DOCUMENTS

| | | | | |
|---|---|---|---|---|
| 4,550,234 | A * | 10/1985 | Steinemer | H01H 33/666 218/4 |
| 7,790,997 | B2 * | 9/2010 | Girodet | H01H 33/42 218/7 |
| 8,174,812 | B2 * | 5/2012 | Montich | H01H 33/666 361/115 |
| 8,847,095 | B2 * | 9/2014 | Donzel | H01H 33/666 218/7 |
| 2007/0151953 | A1 * | 7/2007 | Meinherz | H02B 5/06 218/155 |
| 2012/0268223 | A1 * | 10/2012 | Reuber | H01H 33/38 335/15 |
| 2013/0270089 | A1 | 10/2013 | Fuge et al. | |
| 2018/0005784 | A1 | 1/2018 | Nagatake et al. | |

FOREIGN PATENT DOCUMENTS

| | | | |
|---|---|---|---|
| DE | 102015217410 | A1 | 3/2017 |
| DE | 102016218355 | A1 | 3/2018 |
| WO | 2014075739 | A1 | 5/2014 |

* cited by examiner

CIRCUIT BREAKER

BACKGROUND OF THE INVENTION

Field of the Invention

The invention relates to a circuit breaker for the interruptible connection of at least two sections of line, comprising at least one pair of vacuum tubes, which respectively comprise a fixed switching contact and a movable switching contact, the switching contacts of the at least one pair of vacuum tubes being electrically connected in series.

The use of vacuum tubes as circuit breaker elements, in particular when combined with housings that are filled with dehumidified air as an insulating medium, makes it possible to create switching devices with no environmental impact, since it is possible to do without insulating gases such as sulfur hexafluoride. The vacuum tubes are generally installed in the housings horizontally or vertically, with the movable contact at the bottom. Using vacuum tubes as switching elements for high voltage and ultra-high voltage applications may make it necessary for a number of vacuum tubes to be connected in series to ensure the dielectric strength of the circuit breaker. The use of vacuum tubes in circuit breakers offers the advantage over other types of breaker, such as gas circuit breakers, that the vacuum tubes can be operated substantially maintenance-free. The use of vacuum tubes in circuit breakers is already known in the prior art.

DE 10 2015 212 826 A1 discloses a feedthrough for the electrically conductive connection of two sections of conductor through a wall of a housing. The feedthrough comprises a vacuum tube, in which the sections of conductor are electrically insulated with respect to an encapsulation of the vacuum tube and also are electrically insulated by the encapsulation with respect to the housing. By switching the vacuum tube, the two sections of conductor can be electrically isolated.

DE 10 2016 218 355 A1 discloses a cable sleeve assembly for supplying electrical power, in which an interrupter unit that can be switched by means of a drive unit is arranged within a cable sleeve between two electrical sections of line of an electrical line of a phase of an electric cable. The interrupter unit may be configured as a vacuum tube with a fixed contact and a movable contact.

BRIEF SUMMARY OF THE INVENTION

The invention is based on the object of providing an improved circuit breaker comprising at least two switchable vacuum tubes.

To achieve this object, it is provided according to the invention that the movable switching contacts of the vacuum tubes are coupled to a common actuator and can be simultaneously switched by a movement of the actuator.

The advantage of the way in which this is achieved according to the invention is that it is possible to do without switching of the movable switching contacts of the vacuum tubes by multiple separate drive units, which would have to be complexly synchronized for simultaneous switching of the at least two vacuum tubes. The coupling of the movable switching contacts of the vacuum tubes to the actuator can take place for example by means of a movement mechanism that is comparatively easy to realize, so that the space requirement of the circuit breaker and its structural complexity can be advantageously reduced.

The switching contacts of the pair of vacuum tubes are connected in series in the closed state of the switching contacts and the two sections of line are electrically connected. When the switching contacts of the vacuum tubes open, a distance is created between the movable switching contacts and the fixed switching contacts, so that the two sections of line are no longer electrically connected. The simultaneous switching of the two vacuum tubes makes it possible to use the circuit breaker for switching voltages that lie above the rated voltage of a single one of the vacuum tubes. In this way it is made possible for example also to use the circuit breaker based on vacuum tubes for switching devices and switching installations with rated voltages $U_m$ of >245 kV. Also in the case of lower rated voltages, for example rated voltages $U_m$ of ≤170 kV, there is potential for savings to be achieved by using two vacuum tubes as compared with using a single, larger tube. In addition, it is also possible that an increase in the short-circuit breaking capacity of the circuit breaker can be achieved by using two vacuum tubes.

The fixed switching contacts of the vacuum tubes are preferably electrically connected in each case to one of the sections of line to be interruptibly connected. The movable switching contacts switch the vacuum tube, and consequently the connection between the sections of line, when they are themselves moved by a movement of the actuator and the physical contact between the fixed switching contact and the movable switching contact of a vacuum tube is interrupted. The movable switching contacts of the two vacuum tubes of a pair of vacuum tubes are in this case electrically connected to one another to form the series connection. This may take place for example by the movable switching contacts being respectively connected by way of a sliding contact to a conductor of the circuit breaker, the switching contacts being electrically connected to one another by way of the conductor, at least in the closed state of the vacuum tubes. In this way, when the vacuum tubes are closed, a current flow is achieved between the two sections of line separably connected by the circuit breaker.

The fixed switching contact and the movable switching contact of the vacuum tubes are at least partially accommodated in an evacuated capsule, with in particular a contact area between the fixed switching contact and the movable switching contact lying within the evacuated capsule, that is to say within the vacuum in the capsule, when the vacuum tube is closed. The arrangement of the contact area in the vacuum makes it possible to use the vacuum tube, and in particular a series connection of two vacuum tubes, for switching high voltages. The circuit breaker may for example be designed for switching voltages of 245 kV and more, but also for lower voltages, for example in a range of 10 kV to 170 kV or in a range of 170 kV to 245 kV.

According to the invention, it may be provided that the movable switching contacts are coupled to the actuator by way of a common actuating element. The use of a common actuating element allows simultaneous switching of the movable switching contacts of the vacuum tubes to be achieved in an easy way. By a movement of the actuator, the actuating element can be moved in such a way that, as a result of the coupling between the movable switching contacts and the actuating element, the movable switching contacts also move in such a way that they are moved from a closed position into an open position. It goes without saying that it is possible that, by a further movement of the actuator, for example by a movement in an opposite direction of movement, a movement of the movable switching contacts from an open state into a closed state is also possible, so that both opening of the switching contacts of the vacuum tubes, and consequently of the circuit breaker, and closing of the switching contacts of the vacuum tubes or of the circuit breaker by the actuator are possible.

For the actuating element, it may be provided according to the invention that it is a rotating shaft, in particular a crankshaft, or a linearly movable actuating element. The configuration of the actuating element as a shaft, in particular as a crankshaft, or as a linearly movable actuating element, makes it possible to implement switching of the vacuum tubes or moving of the movable switching contacts with a mechanism that is as easy as possible to realize. Furthermore, the use of a rotating shaft, such as a crankshaft, or a linearly movable actuating element, allows a simultaneous, and in particular also rapid, movement of the movable switching contacts to be achieved.

For the coupling of the movable switching contacts to the actuating element, it may be provided according to the invention that the movable switching contacts of the vacuum tubes are coupled to the actuating element in each case by way of a connecting rod. Each of the connecting rods may in this case be mounted for example by way of a rotary bearing on the movable switching contact assigned to it and also mounted by way of a further rotary bearing on the actuating element. In this way, in particular, a rotary movement of an actuating element configured as a shaft or a linear movement of an actuating element configured as a linear actuating element can be converted into a movement of the movable switching contacts for switching the vacuum tubes.

According to the invention, it may be provided that the actuating element and/or the connecting rods consist of an electrically insulating material, in particular a glass-fiber-reinforced plastic and/or a Kevlar-reinforced plastic. The use of insulating materials for the actuating element and/or the connecting rods avoids transference of the electrical voltage that is at the movable switching contacts in the closed state also to the components of the movement mechanism and/or the actuator.

In a preferred embodiment of the invention, it may be provided that the vacuum tubes of the at least one pair of vacuum tubes are arranged at an angle to one another in such a way that the movable switching contacts are directed toward the actuating element and are coupled to it, the actuating element being arranged between the vacuum tubes. The vacuum tubes may in this case be arranged in a V shape, in a way similar to the cylinders in a V-type engine. The movable switching contacts may in this case be directed downward and be coupled to an actuating element that is in particular arranged midway between the vacuum tubes.

The vacuum tubes may be arranged in the same position with respect to a longitudinal direction of the actuating element or it may be provided that the vacuum tubes are offset somewhat in relation to one another in the longitudinal direction of the actuating element, in order to simplify the coupling of the movable switching contacts to the actuating element.

Furthermore, it may be provided according to the invention that the circuit breaker comprises three pairs of vacuum tubes, the switching contacts of the vacuum tubes of each pair being electrically connected in series with in each case two sections of line and the pairs being at a distance from one another in each case in a longitudinal direction of the actuating element, the actuating element being coupled to the movable switching contacts of the vacuum tubes of the three pairs. In this way it is made possible to use the circuit breaker also for performing simultaneous switching of three separate phases in a three-phase system. Each pair of the vacuum tubes is in this case assigned to two sections of line of a phase, so that the three pairs of vacuum tubes can be used for switching altogether three different phases. The actuating element is in this case coupled to the movable switching contacts of all the vacuum tubes, so that the three phases or the six vacuum tubes can be switched simultaneously by a movement of the actuator. The arrangement of the pairs at a distance in the longitudinal direction of the actuating element achieves a space-saving construction of the circuit breaker that can also be switched by a simple and robust mechanism.

According to the invention, it may be provided that the actuator is an electric motor. The electric motor allows for example a rotary movement of the actuating element, in particular an actuating element configured as a shaft or as a crankshaft, to be achieved. It is also possible that a rotary movement of the electric motor is converted into a linear movement of an actuating element configured as a linear actuating element, or that the electric motor is a linear motor, which can directly produce a linear movement of a linear actuating element.

In a preferred configuration of the invention, it may be provided that the vacuum tubes are arranged in a common housing, in particular in a dead-tank circuit breaker housing or a live-tank circuit breaker housing. In the case of a dead-tank circuit breaker housing, the housing is at a ground potential. In the case of a live-tank circuit breaker housing, the housing is insulated with respect to the outside. The housing of the circuit breaker may be filled with an insulating protective gas, for example with dehumidified air, also referred to as clean air, or some other protective gas, for example sulfur hexafluoride. The housing protects the vacuum tubes from external influences and also serves for shielding the switching contacts of the vacuum tubes, which in particular in the closed state carry a high voltage, from their surroundings. Furthermore, the actuator and/or a movement mechanism provided for coupling the movable switching contacts to the actuator may also be accommodated in the housing. It is also possible that the actuator is located outside the housing and for example a movement mechanism for implementing the coupling between the movable switching contacts and the actuator is partially fed through the housing.

According to the invention, it may be provided that the vacuum tubes are in each case arranged in a feedthrough, through which in each case one of the sections of line is fed into the housing. In this way, a space-saving integration of the vacuum tubes in the housing can be advantageously performed. In particular in the case of a housing connected to ground potential, the vacuum tubes may also be used for insulating the feedthroughs, so that overall the construction of the circuit breaker can be simplified and implemented in a space-saving manner.

For the feedthroughs, it may be provided according to the invention that they are arranged at an angle to one another in a housing top of the housing, the actuating element being arranged between and under the feedthroughs. In particular with feedthroughs arranged at an angle to one another, it is made possible also to arrange the vacuum tubes at an angle to one another, so that, as described above, an arrangement of the vacuum tubes in a V shape is possible even when they are integrated in the feedthroughs.

Further advantages and configurations of the invention emerge from the exemplary embodiments described below and also on the basis of the schematic drawings, in which:

DETAILED DESCRIPTION OF THE INVENTION

Figure 1:
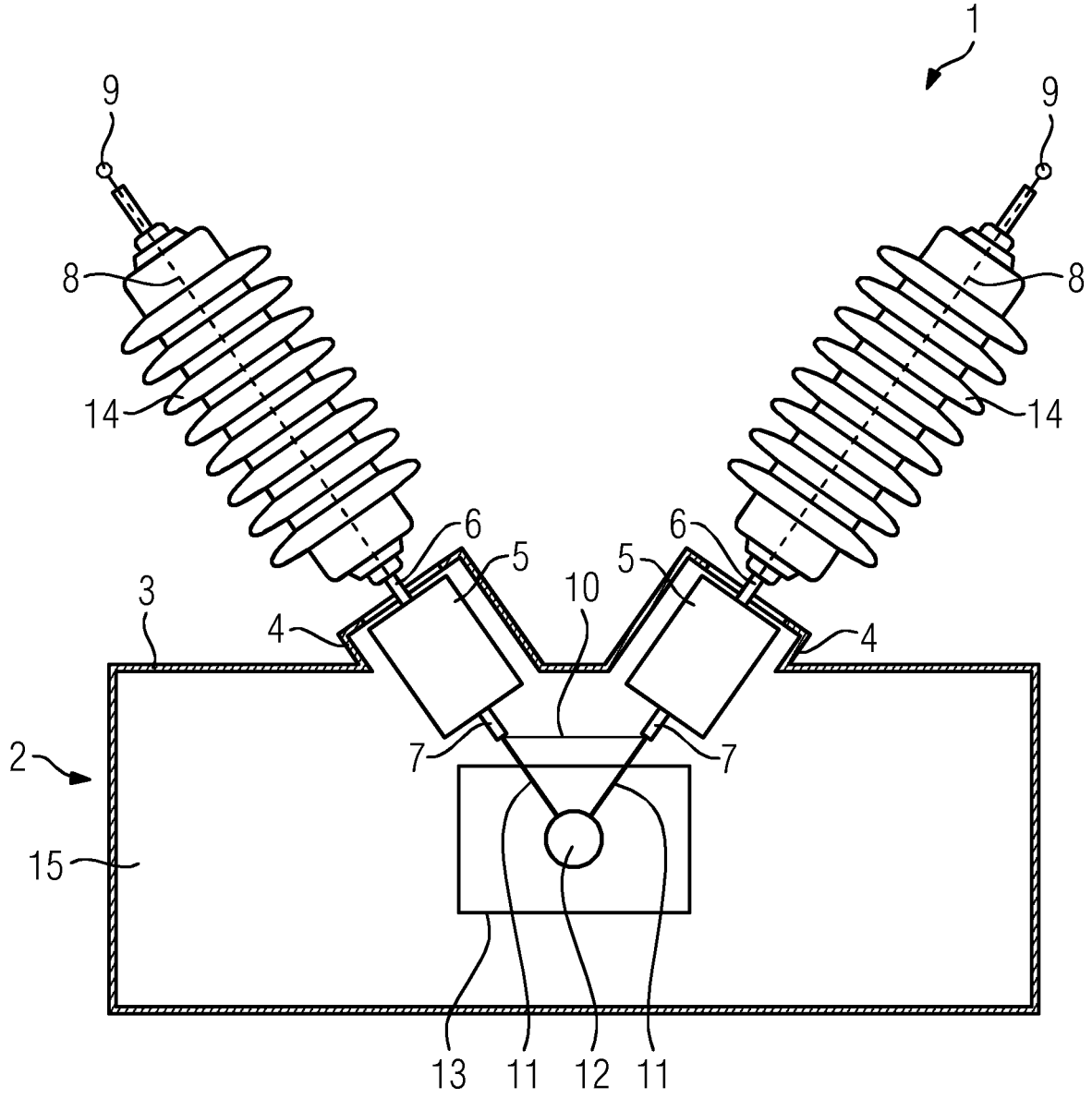
FIG. 1 shows a representation of a first exemplary embodiment of a circuit breaker according to the invention.

In FIG. 1, a schematic representation of a first exemplary embodiment of a circuit breaker 1 according to the invention is shown. The circuit breaker 1 according to the invention comprises a housing 2, two feedthroughs 4 being arranged at an angle to one another in a housing top 3 of the housing 2. Respectively arranged in each of the feedthroughs 4 is a vacuum tube 5 of a pair of vacuum tubes 5. The vacuum tubes 5 respectively comprise a fixed switching contact 6 and a movable switching contact 7, the fixed switching contact 6 being connected to a section of line 9 by way of an electrical connection 8. The construction of a vacuum tube 5 is explained more specifically below with reference to FIG. 2.

The pair of vacuum tubes 5 serves for the interruptible connection of the two sections of line 9. For this purpose, the two movable switching contacts 7 are respectively connected by way of a sliding contact to a conductor 10, so that the movable switching contacts 7 of the vacuum tubes 5 are electrically connected to one another, at least in the closed state or in the conducting state of the vacuum tubes 5. When the switching contacts 6, 7 are closed, that is to say when the circuit breaker 1 is closed, the sections of line 9 are electrically connected to one another.

The movable switching contacts 7 are connected to an actuator 13 by way of a movement mechanism 11 comprising an actuating element 12. By a movement of the actuator 13, the movable switching contacts 7 of the vacuum tubes 5 can be switched simultaneously. Closed switching contacts 6, 7, that is to say conductive vacuum tubes 5, can be simultaneously switched by a movement of the actuator 13 from the closed position into the open position by movement of the movable switching contacts 7. Conversely, it is also possible that, by a further movement of the actuator 13, in particular in an opposite direction of movement, the movable switching contacts 7 are brought from the open position, that is to say the blocking position, into the closed position. In this way, the connection between the sections of line 9 can be interrupted or an interrupted connection can be reconnected.

The integration of the vacuum tubes 5 in the feedthroughs 4 of the housing 2 makes a space-saving arrangement of the vacuum tubes 5 inside the housing 2 possible. Furthermore, the arrangement of the vacuum tubes 5 at an angle to one another, that is to say an arrangement of the vacuum tubes in a V shape, makes it possible for simultaneous switching of the vacuum tubes 5 to be easily realized by way of the actuating element 12 and the actuator 13.

The housing 2 may be for example a dead-tank circuit breaker housing, which is at a ground potential. As an alternative to this, the housing 2 may also be a live-tank circuit breaker housing, which is insulated with respect to the outside. In the example shown here, it is a dead-tank circuit breaker housing, the sections of line 9 being insulated from the housing 2 not only by the schematically drawn ceramic insulators 14 but also by way of the vacuum tubes 5. The interior 15 of the housing 2 may also be filled with an insulating gas, for example with dehumidified air or sulfur hexafluoride, for insulation.

Figure 2:
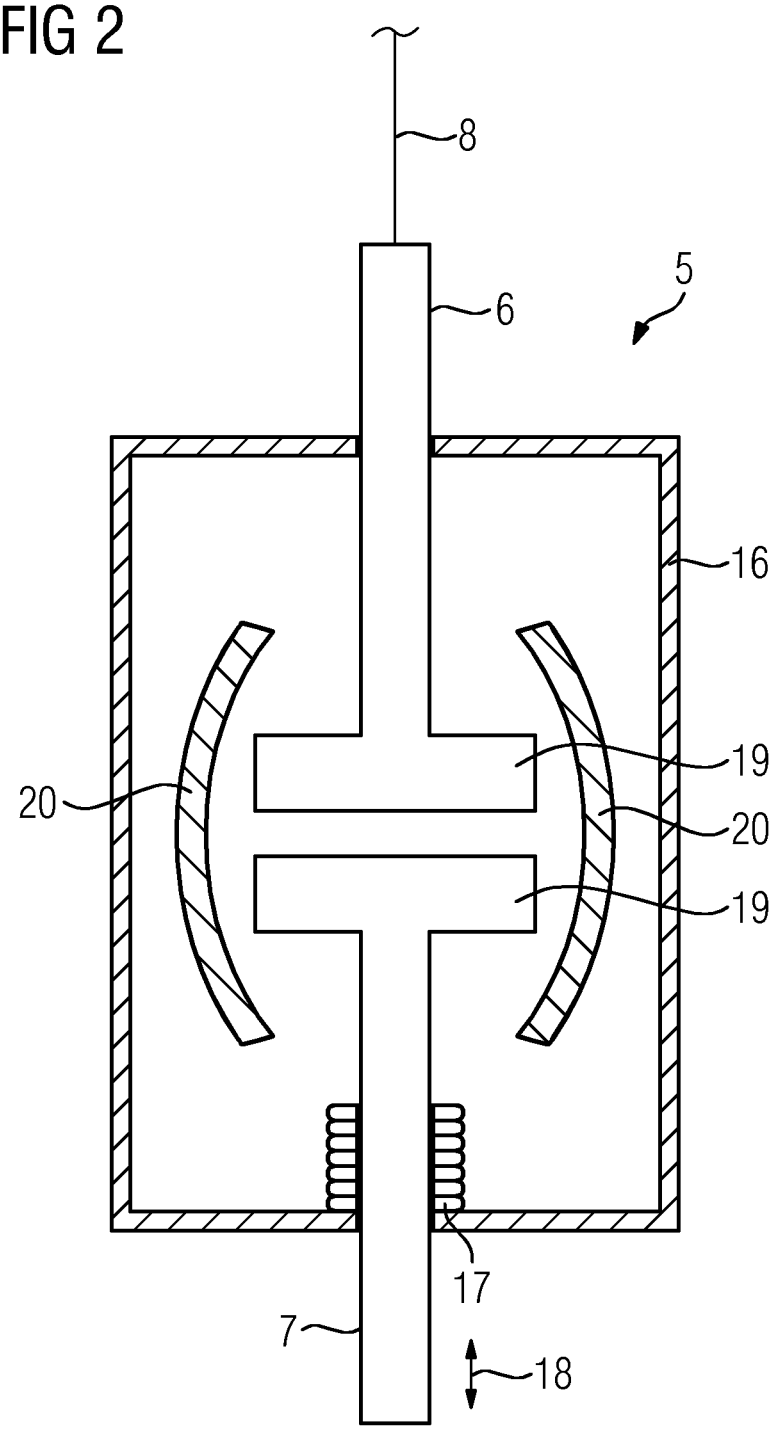
FIG. 2 shows a representation of a vacuum tube.

In FIG. 2, a schematic sectional view of a vacuum tube 5 is represented. The vacuum tube 5 comprises an airtight capsule 16, which consists of an insulating material and the interior 15 of which is evacuated. Both the fixed contact 6 and the movable contact 7 are fed into the interior 15 of the capsule 16. For sealing the vacuum in the interior 15 of the capsule 16 in the region of the movable switching contact 7, a bellows 17 of an airtight material is provided. By a movement of the movable switching contact 7, as indicated by the arrow 18, an electrical connection between the fixed switching contact 6 and the movable switching contact 7 can be established or interrupted. If the movable switching contact 7 has moved toward the fixed switching contact 6, so that the contact pieces 19 of the fixed and movable switching contacts 6, 7 come into contact, the switching contacts 6, 7 are closed and there is a conductive connection between the fixed switching contact 6 and the movable switching contact 7. Conversely, with contact pieces 19 that are in contact, an electrical connection between the switching contact 6 and the movable switching contact 7 can be interrupted, by the movable switching contact 7 being moved away from the fixed switching contact 6. The region of the contact pieces 19 is partially surrounded by a shield 20 of an electrically conductive material, which serves for shaping an electrical field that forms in the interior 15 of the capsule 16 and for limiting the spread of metallic material of the switching contacts 6, 7 that has vaporized during the switching operations.

As shown in FIG. 1, for example the fixed switching contact 6 of a first vacuum tube 5 may be connected by way of the electrical connection 8 to a section of line 9 and the movable switching contact 7 may be connected by way of the conductor 10 to the movable switching contact 7 of a second vacuum tube 5, the fixed switching contact 6 of the second vacuum tube 5 likewise being connected to a section of line 9 to be connected. In this way, a series connection of the vacuum tubes 5 is realized, making it possible to realize a switchable connection of two sections of line 9 at voltage levels above the rated voltage of a single one of the vacuum tubes 5.

Figure 3:
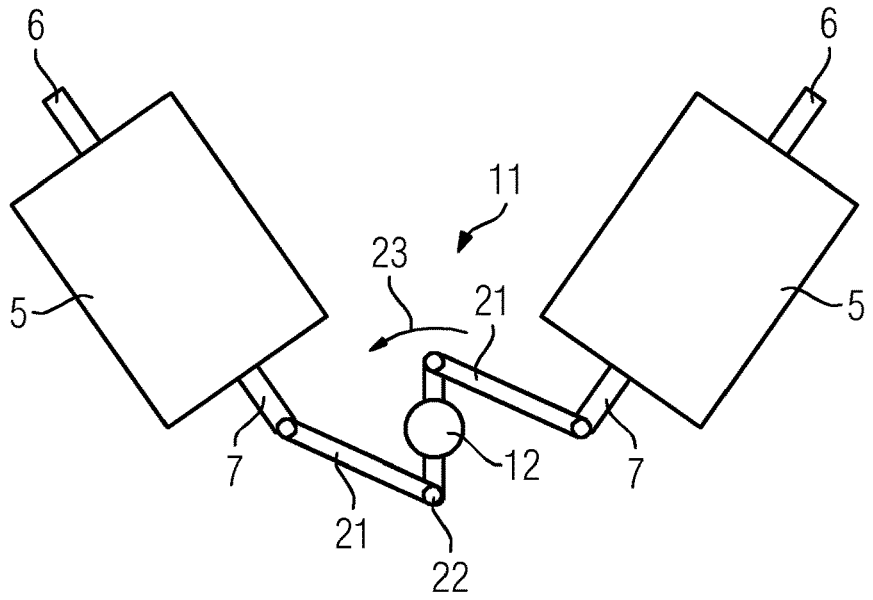
FIG. 3 shows a first exemplary embodiment of a movement mechanism of a circuit breaker according to the invention.

In FIG. 3, a first exemplary embodiment of a movement mechanism 11 for switching the vacuum tubes 5 is represented. In this case, the actuating element 12 is configured as a crankshaft, which is coupled to the movable contacts 7 of the vacuum tubes 5 arranged in a V shape in each case by way of a connecting rod 21. The connecting rods 21 are fastened in each case by way of a rotary bearing 22 to the movable switching contacts 7 and to the crankshaft. The actuating element 12 can be turned in the direction of the arrow 23 by the actuator 13, which is for example configured as an electric motor. The rotary movement of the actuating element 12 has the effect of creating a distance between the movable switching contacts 7 and the fixed switching contacts 6, and consequently opening the switching contacts 6, 7. Conversely, when there is rotation opposite to the direction of the arrow 23, a movement of the fixed switching contacts 7 toward the fixed switching contacts 6 can take place, so that the switching contacts 6, 7 can be closed, and consequently the vacuum tubes 5 can be electrically conductively connected.

Figure 4:
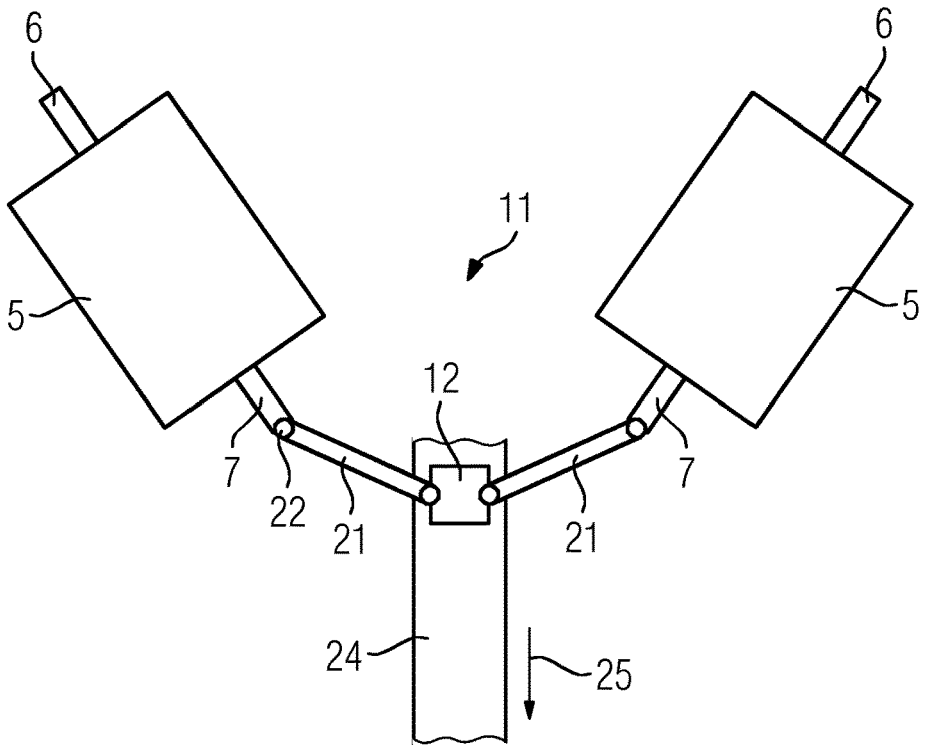
FIG. 4 shows a second exemplary embodiment of a movement mechanism of a circuit breaker according to the invention.

In FIG. 4, a second exemplary embodiment of the movement mechanism 11 of a circuit breaker 1 according to the invention is represented. In this exemplary embodiment, the actuating element 12 is configured as a linearly movable actuating element, with which, as described above, the movable switching contacts 7 of the vacuum tubes 5 are coupled in each case by way of a connecting rod 21 and two rotary bearings 22. The linearly movable actuating element 12 is mounted in a guide 24 and is coupled to the actuator 13, for example an electric linear motor, which is not represented in FIG. 4. The linearly movable actuating element 12 can be moved by the actuator 13 in the guide in the direction of the arrow 25, in order to open the switching contacts 6, 7 by movement of the movable switching contacts 7. Closing of the switching contacts 6, 7 can take place correspondingly by movement of the linearly movable actuating element 12 counter to the direction of the arrow 25, so that the movable switching contacts 7 are again moved into contact with the fixed switching contacts 6.

Figure 5:
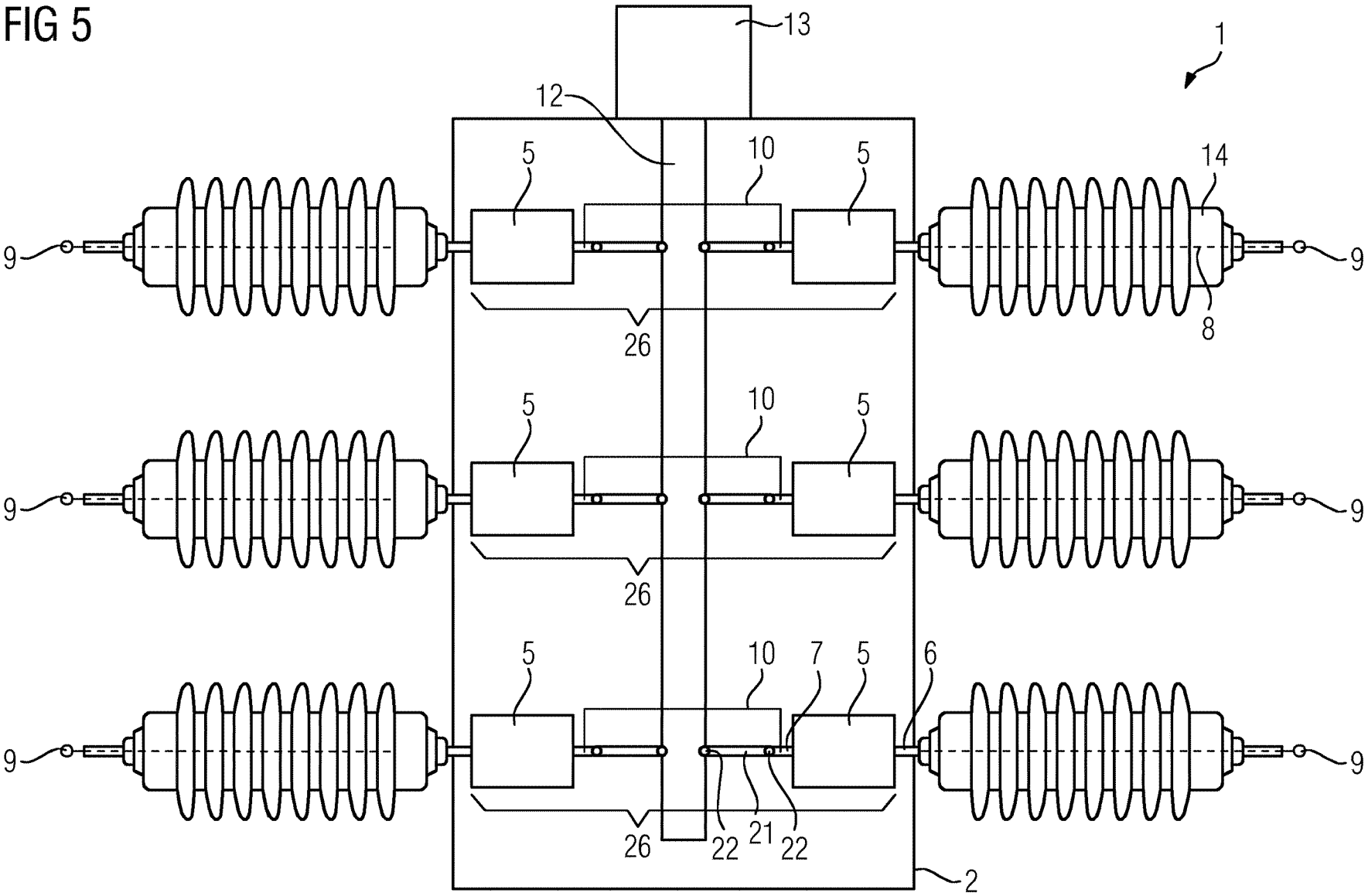
FIG. 5 shows a second exemplary embodiment of a circuit breaker according to the invention.

In FIG. 5, a second exemplary embodiment of a circuit breaker 1 according to the invention is represented. The circuit breaker 1 comprises three pairs 26 of two vacuum tubes 5 each, which are arranged offset along a longitudinal direction of the actuating element 12. Each of the pairs 26 of the vacuum tubes 5 serves for the switchable connection of two sections of line 9. As a result of the use of three pairs 26 of vacuum tubes 5, it is made possible by the circuit breaker 1 to switch electrical connections in a three-phase power system, each pair 26 of the vacuum tubes 5 respectively switching a phase. The movable switching contacts 7 are coupled to the actuating element 12 by way of the connecting rods 21 and the rotary bearings 22. The movement mechanism may in this case be configured in a way corresponding to the exemplary embodiments shown in FIG. 3 or 4. By a movement of the actuator 13, a simultaneous movement of all the movable switching contacts 7 of the pairs 26 of vacuum tubes 5 can take place, so that all three phases can be switched simultaneously by the circuit breaker 1. It goes without saying that the movable switching contacts 7 of a pair 26 of vacuum tubes 5 are conductively connected, for example in each case by way of a conductor 10 as shown above in relation to FIG. 1, so that the two sections of line 9, which are electrically connected to the vacuum tubes 5 of a pair 26, are electrically conductively connected or electrically isolated, depending on the switching state of the vacuum tubes 5.

It goes without saying that, also in the case of the configuration of a circuit breaker with three pairs 26 of vacuum tubes 5, the vacuum tubes 5 may be respectively arranged in a V shape, as shown above. In addition or as an alternative to this, it is possible that the vacuum tubes 5 are in each case arranged in a feedthrough 4 in the housing top 3 of a housing 2 of the circuit breaker 1, so that overall an altogether compact construction is also achieved for the circuit breaker 1 for switching three-phase current. In this exemplary embodiment, the actuator 13 is located outside the housing 2, the actuating element 12 being fed through an outer wall of the housing 2 and connected to the actuator 13. It goes without saying that it is also possible that the actuator 13 is arranged inside the housing 2.

In order to insulate the actuator 13 from the high voltage, it may be provided in all of the exemplary embodiments that the actuating element 12, or the crankshaft or the linearly movable actuating element, and also the connecting rods 21 consist of an insulating material, such as a glass-fiber-reinforced plastic or a Kevlar-reinforced plastic. In this way, a current flow through the movement mechanism 11 or the actuating element 12 to the actuator 13 is also prevented when the circuit breaker 1 is closed.

Although the invention has been illustrated more specifically and described in detail by the preferred exemplary embodiment, the invention is not restricted by the examples disclosed and other variations may be derived therefrom by a person skilled in the art without departing from the scope of protection of the invention.

LIST OF REFERENCE SYMBOLS

1 Circuit breaker
2 Housing
3 Housing top
4 Feedthrough
5 Vacuum tube
6 Fixed switching contact
7 Movable switching contact
8 Electrical connection
9 Section of line
10 Conductor
11 Movement mechanism
12 Actuating element
13 Actuator
14 Ceramic insulator
15 Interior
16 Capsule
17 Bellows
18 Arrow
19 Contact area
20 Shield
21 Connecting rod
22 Rotary bearing
23 Arrow
24 Guide
25 Arrow
26 Pair

The invention claimed is:

1. A circuit breaker for an interruptible connection of at least two sections of line, the circuit breaker comprising:

a pair of vacuum tubes each having a fixed switching contact and a movable switching contact, said switching contacts of said pair of vacuum tubes being electrically connected in series, and said vacuum tubes being arranged in a common housing;

a common actuator coupled to said movable switching contacts of said vacuum tubes and being configured to be simultaneously switched by a movement of said actuator; and a common actuating element coupling said movable switching contacts to said actuator;

said pair of vacuum tubes being one of three pairs of vacuum tubes;

said switching contacts of said vacuum tubes of each said pair are electrically connected in series with two sections of line;

said pairs of vacuum tubes are disposed at a spacing distance from one another in each case in a longitudinal direction of said actuating element;

said actuating element being coupled to said movable switching contacts of said vacuum tubes of said three pairs.

2. The circuit breaker according to claim 1, wherein said common actuating element is a rotating shaft or a linearly movable actuating element.

3. The circuit breaker according to claim 1, wherein said common actuating element is a crankshaft.

4. The circuit breaker according to claim 1, further comprising connecting rods respectively coupling each of said movable switching contacts of said vacuum tubes to said common actuating element.

5. The circuit breaker according to claim 4, wherein at least one of said actuating element or said connecting rods consist of an electrically insulating material.

6. The circuit breaker according to claim 5, wherein said electrically insulating material is at least one material selected from the group consisting of glass-fiber-reinforced plastic and Kevlar®-reinforced plastic.

7. The circuit breaker according to claim 1, wherein said vacuum tubes of said pair of vacuum tubes are arranged at an angle to one another such that said movable switching contacts are directed toward and coupled to said actuating element, and wherein said actuating element is arranged between said vacuum tubes.

8. The circuit breaker according to claim 1, wherein said actuator is an electric motor.

9. The circuit breaker according to claim 1, wherein said common housing is a dead-tank circuit breaker housing or a live-tank circuit breaker housing.

10. The circuit breaker according to claim 1, wherein said housing is formed with feedthroughs and each of said vacuum tubes is arranged in a respective said feedthrough, and each of the sections of line is fed through a respective said feedthrough into the housing.

11. The circuit breaker according to claim 10, wherein said feedthroughs are arranged at an angle relative to one another in a housing top of said housing, and said actuating element is arranged between and below said feedthroughs.

* * * * *